US011841677B2

(12) United States Patent
Sato et al.

(10) Patent No.: US 11,841,677 B2
(45) Date of Patent: Dec. 12, 2023

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Taichi Sato, Shizuoka (JP); Atsushi Fujii, Kanagawa (JP); Hisato Yabuta, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 246 days.

(21) Appl. No.: 17/322,295

(22) Filed: May 17, 2021

(65) Prior Publication Data

US 2021/0364939 A1 Nov. 25, 2021

(30) Foreign Application Priority Data

May 19, 2020 (JP) ..... 2020-087655

(51) Int. Cl.
*G03G 5/14* (2006.01)
*G03G 5/06* (2006.01)
*G03G 5/047* (2006.01)

(52) U.S. Cl.
CPC ..... *G03G 5/144* (2013.01); *G03G 5/047* (2013.01); *G03G 5/0696* (2013.01); *G03G 5/06142* (2020.05)

(58) Field of Classification Search
None
See application file for complete search history.

(56) References Cited

U.S. PATENT DOCUMENTS

| | | | | |
|---|---|---|---|---|
| 5,763,127 | A | 6/1998 | Goshima | |
| 2004/0259009 | A1* | 12/2004 | Itami | G03G 5/10 430/60 |

FOREIGN PATENT DOCUMENTS

| | | | | |
|---|---|---|---|---|
| EP | 2221671 | A1 | 8/2010 | |
| JP | 04195067 | A | 7/1992 | |
| JP | H11-194519 | A | 7/1999 | |
| JP | 2006-011485 | A | 1/2006 | |
| JP | 2016-6476 | * | 1/2016 | G02B 5/208 |
| KR | 2018-0028601 | A | 3/2018 | |

OTHER PUBLICATIONS

Translation of JP 2016-6476.*

* cited by examiner

*Primary Examiner* — Peter L Vajda
(74) *Attorney, Agent, or Firm* — Canon U.S.A., Inc., IP Division

(57) ABSTRACT

An electrophotographic photosensitive member including a support, an intermediate layer, and a photosensitive layer in this order, wherein the intermediate layer comprises a tungsten oxide particle, and the tungsten oxide particle contains a tungsten atom, an oxygen atom, and a cesium atom.

4 Claims, 2 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present disclosure relates to an electrophotographic photosensitive member, a process cartridge including the electrophotographic photosensitive member, and an electrophotographic apparatus including the electrophotographic photosensitive member.

Description of the Related Art

The electrophotographic photosensitive member basically includes a support and a photosensitive layer formed on the support. However, at present circumstances, various layers are often provided between the support and the photosensitive layer in order to conceal defects on a surface of the support, protect the photosensitive layer from electrical breakdown, enhance chargeability, and improve a charge injection inhibition ability to inhibit the charge injection from the support to the photosensitive layer.

A technique of providing an intermediate layer among the layers to be provided between the support and the photosensitive layer is known for the purpose of stabilizing a charging potential or for the purpose of solving the disadvantage of image failure caused by unevenness on the surface of the support or reflection of light on the surface of the support. In addition, a technique of dispersing metal oxide particles in a resin of the intermediate layer is also known. In general, the intermediate layer containing the metal oxide particles has high electroconductivity as compared with a layer containing no metal oxide particles. Therefore, it is easy to form a light-area potential suitable for image formation on a surface of the electrophotographic photosensitive member.

Japanese Patent Application Laid-Open No. H04-195067 proposes an electrophotographic photosensitive member including an intermediate layer in which tungsten oxide particles as metal oxide particles are dispersed in a resin.

According to studies conducted by the present inventors, in the electrophotographic photosensitive member described in Japanese Patent Application Laid-Open No. H04-195067, a variation in light-area potential during long-term use is a disadvantage.

SUMMARY OF THE INVENTION

An aspect of the present disclosure is to provide an electrophotographic photosensitive member in which a variation in light-area potential during long-term use is suppressed.

The above aspect is achieved by the following present disclosure. According to an aspect of the present disclosure, an electrophotographic photosensitive member includes a support, an intermediate layer, and a photosensitive layer in this order, wherein the intermediate layer comprises a tungsten oxide particle, and the tungsten oxide particle contains a tungsten atom, an oxygen atom, and a cesium atom.

According to another aspect of the present disclosure, a process cartridge integrally supports the electrophotographic photosensitive member and at least one unit selected from the group consisting of a charging unit, a developing unit, and a cleaning unit, and is detachably attachable to a main body of an electrophotographic apparatus.

According to still another aspect of the present disclosure, an electrophotographic apparatus includes the electrophotographic photosensitive member, a charging unit, an exposing unit, a developing unit, and a transfer unit.

Further features of the present disclosure will become apparent from the following description of exemplary embodiments with reference to the attached drawings.

DESCRIPTION OF THE EMBODIMENTS

Figure 1:
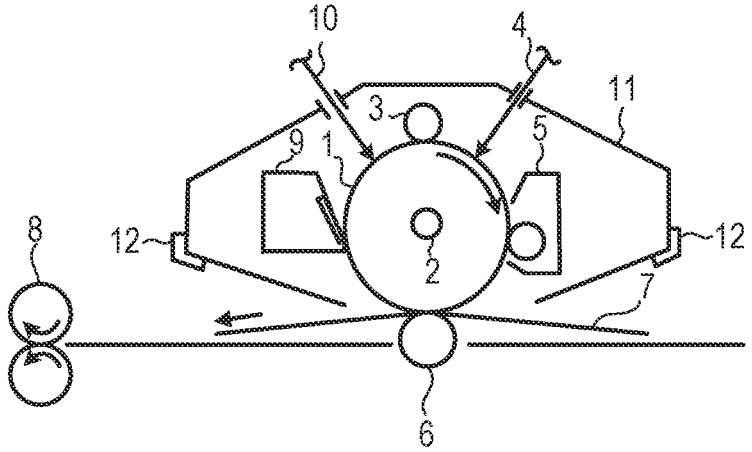
FIG. 1 is a view illustrating an example of a schematic configuration of an electrophotographic image forming apparatus including a process cartridge including an electrophotographic photosensitive member.

Preferred embodiments of the present disclosure will now be described in detail in accordance with the accompanying drawings.

As a result of studies conducted by the present inventors, in the technique described in Japanese Patent Application Laid-Open No. H04-195067, the electroconductivity of the tungsten oxide particles contained in the intermediate layer was reduced due to the repetitive use of the electrophotographic photosensitive member. As a result, it has been found that there is a technical disadvantage in that the electroconductivity of the intermediate layer is reduced and the light-area potential on the surface of the electrophotographic photosensitive member thus varies.

Therefore, in order to solve the technical disadvantage, the present inventors have conducted studies to introduce another type of metal element into the tungsten oxide particles. As a result, it has been found that by allowing the tungsten oxide particles to contain cesium atoms, it is possible to solve the technical disadvantage of the variation in light-area potential on the surface of the electrophotographic photosensitive member due to the long-term use, which occurs in the technique described in Japanese Patent Application Laid-Open No. H04-195067. That is, it is considered that the electroconductivity of the tungsten oxide particles is stabilized by allowing the tungsten oxide particles to contain cesium atoms. Therefore, it is considered that even in a case where the electrophotographic photosensitive member is used for a long period of time, a reduction in electroconductivity of the tungsten oxide particles contained in the intermediate layer is suppressed, and thus, the electroconductivity of the intermediate layer is stabilized and the variation in light-area potential on the surface of the electrophotographic photosensitive member is suppressed.

[Electrophotographic Photosensitive Member]

An electrophotographic photosensitive member according to the present disclosure includes a support, an intermediate layer, and a photosensitive layer in this order.

An example of a method of producing the electrophotographic photosensitive member can include a method in which coating liquids for layers to be described below are prepared and applied on the layers in a desired order and the coating layers are dried. In this case, examples of a method of applying the coating liquid can include dip coating, spray coating, ink jet coating, roll coating, die coating, blade coating, curtain coating, wire bar coating, and ring coating. Among them, dip coating is preferred from the viewpoints of efficiency and productivity.

Hereinafter, the support and the respective layers will be described.

<Support>

In the present disclosure, the electrophotographic photosensitive member includes a support. The support is preferably an electroconductive support having electroconductivity. In addition, examples of a shape of the support can include a cylindrical shape, a belt shape, and a sheet shape. Among them, a cylindrical support is preferred. In addition, a surface of the support may be subjected to an electrochemical treatment such as anodization, a blast treatment, a centerless grinding treatment, or a cutting treatment.

As a material for the support, a metal, a resin, or glass is preferred.

Examples of the metal can include aluminum, iron, nickel, copper, gold, and stainless steel, or alloys thereof. Among them, an aluminum support obtained by using aluminum is preferred.

In addition, electroconductivity may be imparted through a treatment such as mixing or coating of the resin or glass with an electroconductive material.

<Intermediate Layer>

In the present disclosure, the intermediate layer is formed on the support, and contains tungsten oxide particles and a binder material.

In addition, the tungsten oxide particles contain tungsten atoms, oxygen atoms, and cesium atoms. The tungsten oxide particles contain the cesium atoms, such that electroconductivity of the tungsten oxide particles can be stabilized, thereby obtaining an intermediate layer in which preferred electroconductivity can be maintained.

Particles having various shapes such as a spherical shape, a polyhedral shape, an ellipsoidal shape, a flaky shape, and a needle shape can be used as the tungsten oxide particles.

Among them, a particle having a spherical shape, a polyhedral shape, or an ellipsoidal shape is preferred, from the viewpoint of reducing image failure such as black spots.

It is more preferable that the tungsten oxide particle of the present disclosure has a spherical shape or a polyhedral shape close to a spherical shape.

A number average particle size of the tungsten oxide particles is preferably 50 to 800 nm.

When the number average particle size of the tungsten oxide particles is 50 nm or more, after a coating liquid for an intermediate layer is prepared, reaggregation of the tungsten oxide particles is less likely to occur. Therefore, the stability of the coating liquid for an intermediate layer is not reduced, and the occurrence of cracks formed on a surface of the intermediate layer can be suppressed.

When the number average particle size of the tungsten oxide particles is 800 nm or less, roughening of the surface of the intermediate layer can be suppressed. Therefore, local charge injection into the photosensitive layer is less likely to occur, and black points (black spots) on a white background of an output image are not observed.

The number average particle size of the tungsten oxide particles is more preferably 100 to 400 nm.

In a case where the tungsten oxide particle has a shape other than the spherical shape, a diameter of a sphere having the same volume is a particle size of the tungsten oxide particle.

A composition ratio of the cesium atoms to tungsten atoms contained in the tungsten oxide particles is preferably 0.1 to 10.0%. That is, when the tungsten oxide particle containing the cesium atom is represented by a composition formula of $Cs_xWO_3$, x is preferably 0.001 to 0.100. Hereinafter, unless otherwise specified, a content ratio of the cesium atoms to all the tungsten atoms in the tungsten oxide particles is represented by a composition ratio.

When the content ratio of the cesium atoms in the tungsten oxide particles is 0.1% or more, it is possible to enhance an effect of suppressing a variation in light-area potential on a surface of the electrophotographic photosensitive member. In addition, when the content ratio of the cesium atoms in the tungsten oxide particles is 10.0% or less, the electroconductivity of the tungsten oxide particles is not reduced, and thus, an increase in film resistance of the intermediate layer can be suppressed, and a decrease in initial sensitivity can be suppressed.

The composition ratio of the cesium atoms to the tungsten atoms contained in the tungsten oxide particles is more preferably 0.1 to 5.0%.

In addition, the tungsten oxide particle may have a so-called core-shell structure. In this case, it is preferable that a shell structure portion is tungsten oxide containing a cesium atom. Examples of a core structure portion can include metal oxides such as titanium oxide and barium sulfate.

A surface of the tungsten oxide particle may be treated with a silane coupling agent or the like.

The intermediate layer preferably contains 20 to 50 vol % of the tungsten oxide particles with respect to a total volume of the intermediate layer.

When a content of the tungsten oxide particles in the intermediate layer is 20 vol % or more with respect to the total volume of the intermediate layer, a distance between the tungsten oxide particles is not too long. The longer the distance between the tungsten oxide particles is, the higher the volume resistivity of the intermediate layer tends to be. When the volume resistivity of the intermediate layer is high, a flow of charges is stagnated at the time of image formation, which causes an increase in residual potential. Furthermore, the variation in light-area potential may occur due to the increase in residual potential.

When the content of the tungsten oxide particles in the intermediate layer is 50 vol % or less with respect to the total volume of the intermediate layer, the tungsten oxide particles are hardly in contact with each other. In a case where the tungsten oxide particles are in contact with each other, a portion where the tungsten oxide particles are in contact with each other becomes a portion where the volume resistivity of the intermediate layer is locally reduced, which causes a leak in the electrophotographic photosensitive member.

The intermediate layer more preferably contains 30 to 45 vol % of the tungsten oxide particles with respect to the total volume of the intermediate layer.

The intermediate layer may also contain additional electroconductive particles other than the tungsten oxide particles. Examples of a material for the additional electroconductive particle can include a metal oxide and a metal.

Examples of the metal oxide can include zinc oxide, aluminum oxide, indium oxide, silicon oxide, zirconium oxide, tin oxide, titanium oxide, magnesium oxide, antimony oxide, and bismuth oxide. Examples of the metal can include aluminum, nickel, iron, nichrome, copper, zinc, and silver.

In a case where the metal oxide is used for the additional electroconductive particle, a surface of the metal oxide may be treated with a silane coupling agent or the like, or the metal oxide may be doped with an element such as phosphorus or aluminum, or an oxide thereof.

In addition, the additional electroconductive particle may have a laminate structure having a core particle and a coating layer that coats the core particle. Examples of a material for the core particle can include titanium oxide, barium sulfate, and zinc oxide. An example of a material for the coating layer can include a metal oxide such as tin oxide.

In a case where the metal oxide is used for the electroconductive particle other than the tungsten oxide particle, a volume average particle size thereof is preferably 1 to 500 nm, and more preferably 3 to 400 nm.

In a case where the intermediate layer contains the additional electroconductive particles other than the tungsten oxide particles, a total content ratio of the tungsten oxide particles and the additional electroconductive particles in the intermediate layer is preferably 20 to 50 vol % with respect to the total volume of the intermediate layer.

Examples of the binder material can include a polyester resin, a polycarbonate resin, a polyvinyl acetal resin, an acrylic resin, a silicone resin, an epoxy resin, a melamine resin, a polyurethane resin, a phenol resin, and an alkyd resin.

As the binder material, a thermosetting phenol resin or a thermosetting polyurethane resin is preferred. In a case where a curable resin is used as the binder material in the intermediate layer, the binder material contained in the coating liquid for an intermediate layer is a monomer and/or oligomer of the curable rein.

In addition, the intermediate layer may further contain a masking agent such as silicone oil, resin particles, or titanium oxide.

A thickness of the intermediate layer is preferably 1 to 50 μm, and particularly preferably 3 to 40 μm.

A proportion (composition ratio) of the cesium atoms to the tungsten atoms in the tungsten oxide particles can be measured using an ICP optical emission spectrometer. As a measurement target, it is possible to use an intermediate layer obtained by peeling off layers other than the intermediate layer of the electrophotographic photosensitive member and scrapping off the intermediate layer. In addition, a powder formed of the same material as that of the tungsten oxide particle used in the intermediate layer can be used as the measurement target. A solution obtained by dissolving the measurement target in an acid such as sulfuric acid is measured.

In the present disclosure, the volume resistivity of the intermediate layer is preferably $1.0\times10^{8}$ to $1.0\times10^{13}$ Ω·cm. When the volume resistivity of the intermediate layer is $1.0\times10^{13}$ Ω·cm or less, a flow of charges is less likely to be stagnated at the time of image formation, and thus, the residual potential is less likely to be increased. Therefore, the variation in light-area potential is suppressed. In addition, when the volume resistivity of the intermediate layer is $1.0\times10^{8}$ Ω·cm or more, the amount of charges flowing in the intermediate layer during charging of the electrophotographic photosensitive member is less likely to be too large, and the leak is less likely to occur. Furthermore, the volume resistivity of the intermediate layer is more preferably $1.0\times10^{8}$ to $1.0\times10^{12}$ Ω·cm.

Figure 2:
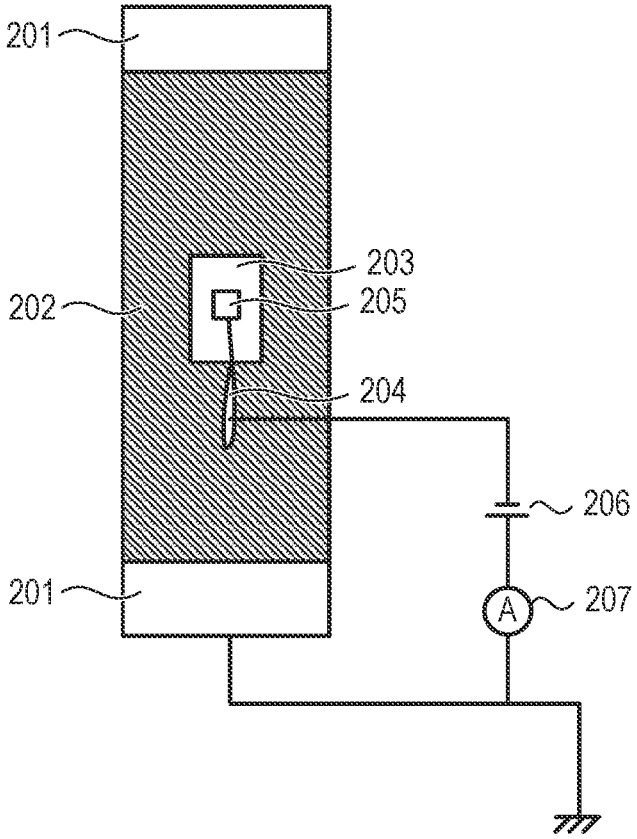
FIG. 2 is a top view illustrating a method of measuring a volume resistivity of an intermediate layer.
Figure 3:
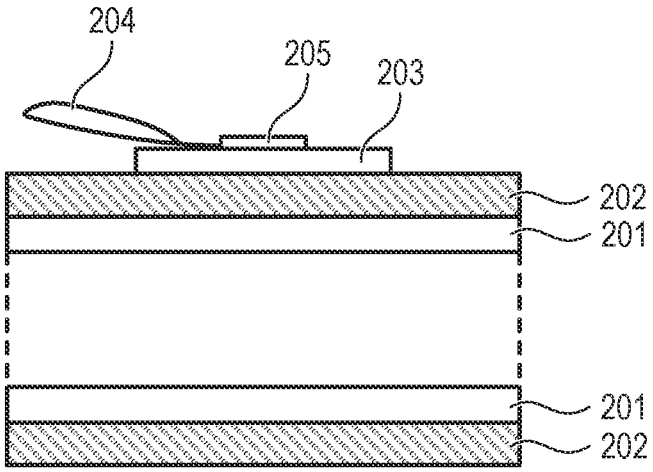
FIG. 3 is a cross-sectional view illustrating the method of measuring the volume resistivity of the intermediate layer.

A method of measuring the volume resistivity of the intermediate layer of the electrophotographic photosensitive member will be described with reference to FIGS. 2 and 3. FIG. 2 is a top view illustrating a method of measuring the volume resistivity of the intermediate layer, and FIG. 3 is a cross-sectional view illustrating the method of measuring the volume resistivity of the intermediate layer.

The volume resistivity of the intermediate layer is measured under a normal temperature and normal humidity (temperature 23° C./relative humidity 50%) environment. A copper tape 203 (for example, manufactured by Sumitomo 3M Limited, model No. 1181) is stuck to a front surface of an intermediate layer 202 to be used as an electrode on the front surface of the intermediate layer 202. In addition, a support 201 is used as an electrode on a rear surface of the intermediate layer 202. A power source 206 for applying a voltage between the copper tape 203 and the support 201 and a current measuring device 207 for measuring a current flowing between the copper tape 203 and the support 201 are installed. In addition, in order to apply the voltage to the copper tape 203, a copper wire 204 is placed on the copper tape 203, a copper tape 205 similar to the copper tape 203 is stuck onto the copper wire 204 so that the copper wire 204 does not protrude from the copper tape 203, and the copper wire 204 is fixed to the copper tape 203. The voltage is applied to the copper tape 203 using the copper wire 204.

A background current value when a voltage is not applied between the copper tape 203 and the support 201 is $I_0$(A), and a current value when −1 V of a direct voltage (voltage having only a direct current component) is applied is I(A). In addition, a value calculated by an equation of $[\rho=1/(I-I_0)\times S/d]$ is a volume resistivity ρ (Ω·cm) of the intermediate layer 202, in which a thickness of the intermediate layer 202 is d (cm) and an area of the electrode formed on the front surface of the intermediate layer 202 (copper tape 203) is S ($cm^2$).

In this measurement, it is preferable that a device capable of measuring a minute current is used as the current measuring device 207 in order to measure a minute amount of current of $1\times10^{-6}$ A or less in terms of an absolute value. An example of such a device can include a pA meter 4140B manufactured by Yokogawa Hewlett-Packard Company. The same values of the volume resistivity of the intermediate layer are obtained in both measurement performed in a state where only the intermediate layer is formed on the support and measurement performed in a state where only the intermediate layer remains on the support by peeling off the respective layers (the photosensitive layer and the like) formed on the intermediate layer from the electrophotographic photosensitive member.

The intermediate layer can be formed by preparing a coating liquid for an intermediate layer containing the above-described respective materials and a solvent, forming a coating film thereof, and drying the coating film. Examples of the solvent used in the coating liquid can include an alcohol-based solvent, a sulfoxide-based solvent, a ketone-based solvent, an ether-based solvent, an ester-based solvent, and an aromatic hydrocarbon-based solvent. Examples of a method for dispersing the electroconductive particles in the coating liquid for an intermediate layer can include methods using a paint shaker, a sand mill, a ball mill, and a liquid collision-type high-speed disperser.

<Undercoat Layer>

In the present disclosure, an undercoat layer may be provided on the intermediate layer. By providing the undercoat layer, an adhesive function between layers can be increased to impart a charge injection inhibiting function.

The undercoat layer preferably contains a resin. In addition, the undercoat layer may be formed as a cured film by polymerization of a composition containing a monomer having a polymerizable functional group.

Examples of the resin can include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the polymerizable functional group included in the monomer having the polymerizable functional group can include an isocyanate group, a block isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron transporting substance, a metal oxide, a metal, an electroconductive polymer, and the like, in order to improve electric characteristics. Among them, an electron transporting substance or a metal oxide is preferably used.

Examples of the electron transporting substance can include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron transporting substance having a polymerizable functional group may be used as the electron transporting substance and copolymerized with the above-described monomer having the polymerizable functional group to form an undercoat layer as a cured film.

Examples of the metal oxide can include indium tin oxide, tin oxide, indium oxide, titanium oxide, zinc oxide, aluminum oxide, and silicon dioxide. Examples of the metal can include gold, silver, and aluminum.

In addition, the undercoat layer may further contain an additive.

A thickness of the undercoat layer is preferably 0.1 to 50 μm, more preferably 0.2 to 40 μm, and particularly preferably 0.3 to 30 μm.

The undercoat layer can be formed by preparing a coating liquid for an undercoat layer containing the above-described respective materials and a solvent, forming a coating film thereof, and drying and/or curing the coating film. Examples of the solvent used in the coating liquid can include an alcohol-based solvent, a ketone-based solvent, an ether-based solvent, an ester-based solvent, and an aromatic hydrocarbon-based solvent.

<Photosensitive Layer>

A photosensitive layer of the electrophotographic photosensitive member is mainly classified into (1) a laminate type photosensitive layer and (2) a monolayer type photosensitive layer. (1) The laminate type photosensitive layer has a charge generation layer containing a charge generating substance and a charge transport layer containing a charge transporting substance. (2) The monolayer type photosensitive layer has a photosensitive layer containing both a charge generating substance and a charge transporting substance.

(1) Laminate Type Photosensitive Layer

The laminate type photosensitive layer has a charge generation layer and a charge transport layer.

(1-1) Charge Generation Layer

The charge generation layer contains a charge generating substance and a resin.

Examples of the charge generating substance can include an azo pigment, a perylene pigment, a polycyclic quinone pigment, an indigo pigment, and a phthalocyanine pigment. Among them, an azo pigment or a phthalocyanine pigment is preferred. Among the phthalocyanine pigments, an oxytitanium phthalocyanine pigment, a chlorogallium phthalocyanine pigment, or a hydroxygallium phthalocyanine pigment is preferred.

A content of the charge generating substance in the charge generation layer is preferably 40% by mass to 85% by mass, and more preferably 60% by mass to 80% by mass, with respect to a total mass of the charge generation layer.

Examples of the resin can include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Among them, a polyvinyl butyral resin is more preferred.

In addition, the charge generation layer may further contain an additive such as an antioxidant or an ultraviolet absorber. Specific examples thereof can include a hindered phenol compound, a hindered amine compound, a sulfur compound, a phosphorus compound, and a benzophenone compound.

A thickness of the charge generation layer is preferably 0.1 to 1 μm, and more preferably 0.15 to 0.4 μm.

The charge generation layer can be formed by preparing a coating liquid for a charge generation layer containing the above-described respective materials and a solvent, forming a coating film thereof, and drying the coating film. Examples of the solvent used in the coating liquid can include an alcohol-based solvent, a sulfoxide-based solvent, a ketone-based solvent, an ether-based solvent, an ester-based solvent, and an aromatic hydrocarbon-based solvent.

(1-2) Charge Transport Layer

The charge transport layer contains a charge transporting substance and a resin.

Examples of the charge transporting substance can include a polycyclic aromatic compound, a heterocyclic compound, a hydrazone compound, a styryl compound, an enamine compound, a benzidine compound, a triarylamine compound, and a resin having a group derived from these substances. Among them, a triarylamine compound or a benzidine compound is preferred.

A content of the charge transporting substance in the charge transport layer is preferably 25% by mass to 70% by mass, and more preferably 30% by mass to 55% by mass, with respect to a total mass of the charge transport layer.

Examples of the resin can include a polyester resin, a polycarbonate resin, an acrylic resin, and a polystyrene resin. Among them, a polycarbonate resin or a polyester resin is preferred. As the polyester resin, a polyarylate resin is particularly preferred.

A content ratio (mass ratio) of the charge transporting substance to the resin is preferably 4:10 to 20:10 and more preferably 5:10 to 12:10.

In addition, the charge transport layer may also contain an additive such as an antioxidant, an ultraviolet absorber, a plasticizer, a leveling agent, a lubricity imparting agent, or an abrasion resistance improver. Specific examples thereof can include a hindered phenol compound, a hindered amine compound, a sulfur compound, a phosphorus compound, a benzophenone compound, a siloxane-modified resin, silicone oil, a fluorine resin particle, a polystyrene resin particle, a polyethylene resin particle, a silica particle, an alumina particle, and a boron nitride particle.

A thickness of the charge transport layer is preferably 5 to 50 μm, more preferably 8 to 40 μm, and particularly preferably 10 to 30 μm.

The charge transport layer can be formed by preparing a coating liquid for a charge transport layer containing the above-described respective materials and a solvent, forming a coating film thereof, and drying the coating film. Examples of the solvent used in the coating liquid can include an alcohol-based solvent, a ketone-based solvent, an ether-based solvent, an ester-based solvent, and an aromatic hydrocarbon-based solvent. Among these solvents, an ether-based solvent or an aromatic hydrocarbon-based solvent is preferred.

(2) Monolayer Type Photosensitive Layer

The monolayer type photosensitive layer can be formed by preparing a coating liquid for a photosensitive layer containing a charge generating substance, a charge transporting substance, a resin, and a solvent, forming a coating film thereof, and drying the coating film. Examples of materials of the charge generating substance, the charge transporting substance, and the resin are the same as in the "(1) Laminate type photosensitive layer".

<Protection Layer>

In the present disclosure, a protection layer may be provided on the photosensitive layer. By providing the protection layer, durability can be improved.

The protection layer preferably contains electroconductive particles and/or a charge transporting substance, and a resin.

Examples of the electroconductive particle can include metal oxides such as titanium oxide, zinc oxide, tin oxide, and indium oxide.

Examples of the charge transporting substance can include a polycyclic aromatic compound, a heterocyclic compound, a hydrazone compound, a styryl compound, an enamine compound, a benzidine compound, a triarylamine compound, and a resin having a group derived from these substances. Among them, a triarylamine compound or a benzidine compound is preferred.

Examples of the resin can include a polyester resin, an acrylic resin, a phenoxy resin, a polycarbonate resin, a polystyrene resin, a phenol resin, a melamine resin, and an epoxy resin. Among them, a polycarbonate resin, a polyester resin, or an acrylic resin is preferred.

In addition, the protection layer may also be formed as a cured film by polymerization of a composition containing a monomer having a polymerizable functional group. Examples of the reaction in this case can include a thermal polymerization reaction, a photopolymerization reaction, and a radiation polymerization reaction. Examples of the polymerizable functional group included in the monomer having the polymerizable functional group can include an acrylic group and a methacrylic group. A material having a charge transporting ability may also be used as the monomer having the polymerizable functional group.

The protection layer may also contain an additive such as an antioxidant, an ultraviolet absorber, a plasticizer, a leveling agent, a lubricity imparting agent, or an abrasion resistance improver. Specific examples thereof can include a hindered phenol compound, a hindered amine compound, a sulfur compound, a phosphorus compound, a benzophenone compound, a siloxane-modified resin, silicone oil, a fluorine resin particle, a polystyrene resin particle, a polyethylene resin particle, a silica particle, an alumina particle, and a boron nitride particle.

A thickness of the protection layer is preferably 0.5 to 10 μm, and more preferably 1 to 7 μm.

The protection layer can be formed by preparing a coating liquid for a protection layer containing the above-described respective materials and a solvent, forming a coating film thereof, and drying and/or curing the coating film. Examples of the solvent used in the coating liquid can include an alcohol-based solvent, a ketone-based solvent, an ether-based solvent, a sulfoxide-based solvent, an ester-based solvent, and an aromatic hydrocarbon-based solvent.

[Process Cartridge and Electrophotographic Apparatus]

A process cartridge according to the present disclosure integrally supports the electrophotographic photosensitive member described above and at least one unit selected from the group consisting of a charging unit, a developing unit, and a cleaning unit, and is detachably attachable to a main body of an electrophotographic apparatus.

In addition, the electrophotographic apparatus according to the present disclosure includes the electrophotographic photosensitive member described above, a charging unit, an exposing unit, a developing unit, and a transfer unit.

FIG. 1 illustrates an example of a schematic configuration of an electrophotographic apparatus including a process cartridge including an electrophotographic photosensitive member.

Reference numeral 1 represents a cylindrical electrophotographic photosensitive member, and is rotatably driven about a shaft 2 in the arrow direction at a predetermined peripheral velocity. A surface of the electrophotographic photosensitive member 1 is charged with a predetermined positive or negative potential by a charging unit 3. Although a roller charging method using a roller type charging member is illustrated in FIG. 1, a charging method such as a corona charging method, a proximity charging method, or an injection charging method may also be adopted. The charged surface of the electrophotographic photosensitive member 1 is irradiated with exposure light 4 emitted from an exposing unit (not illustrated), and an electrostatic latent image corresponding to target image information is formed on the surface of the electrophotographic photosensitive member 1. The electrostatic latent image formed on the surface of the electrophotographic photosensitive member 1 is developed with a toner stored in a developing unit 5, and a toner image is formed on the surface of the electrophotographic photosensitive member 1. The toner image formed on the surface of the electrophotographic photosensitive member 1 is transferred onto a transfer material 7 by a transfer unit 6. The transfer material 7 onto which the toner image is transferred is conveyed to a fixing unit 8, is subjected to a treatment for fixing the toner image, and is printed out to the outside of the electrophotographic apparatus. The electrophotographic apparatus may also include a cleaning unit 9 for removing attached materials such as the toner remaining on the surface of the electrophotographic photosensitive member 1 after the transfer. In addition, a so-called cleaner-less system configured to remove the attached materials by the developing unit 5 or the like may be used without separately providing the cleaning unit 9. The electrophotographic apparatus may also include an antistatic mechanism for an antistatic treatment of the surface of the electrophotographic photosensitive member 1 by pre-exposure light 10 emitted from a pre-exposing unit (not illustrated). In addition, a guiding unit 12 such as a rail may be provided for detachably attaching a process cartridge 11 according to the present disclosure to the main body of the electrophotographic apparatus.

The electrophotographic photosensitive member according to the present disclosure can be used in, for example, a laser beam printer, an LED printer, a copying machine, a facsimile, and a composite machine thereof.

According to the present disclosure, it is possible to provide an electrophotographic photosensitive member in which a variation in light-area potential during long-term use is suppressed.

In addition, according to the present disclosure, it is possible to provide a process cartridge and an electrophotographic apparatus that contribute to high-quality image formation.

EXAMPLES

Hereinafter, the present disclosure will be described in more detail with reference to Examples and Comparative Examples. The present disclosure is not limited to the following Examples without departing from the gist thereof. In the description of the following Examples, unless otherwise specified, "part(s)" is on a mass basis.

Synthesis of Tungsten Oxide Particles

Tungsten oxide particles were synthesized by the following method.

(Production Example of Tungsten Oxide Particles 1)

As tungsten oxide particles 1, $Cs_xWO_3$ (x=0.10) particles having a number average particle size of 300 nm were produced by the following method.

The following materials were prepared as raw materials.

Cesium tungstate (VI) ($Cs_2WO_4$) powder (manufactured by Alfa Aesar, purity: 99.9%, number average particle size: 80 μm)

Tungsten (VI) oxide ($WO_3$) powder (manufactured by Kojundo Chemical Laboratory Co., Ltd., purity: 99.9%, number average particle size: 50 μm)

Tungsten (W) powder (manufactured by Kojundo Chemical Laboratory Co., Ltd., purity: 99.9%, number average particle size: 5 μm)

These raw materials were weighed in terms of chemical equivalent according to a desired Cs content x. The following Formula (I) was used to calculate the chemical equivalent corresponding to the Cs content x.

$$x/2[Cs_2WO_4]+x/6[W]+(I-2x/3)[WO_3]\rightarrow[Cs_xWO_3] \quad (I)$$

Each raw material powder weighed in terms of chemical equivalent was placed in a zirconia pot for a planetary ball mill. In addition, zirconia balls (balls having a diameter of 1 mm and balls having a diameter of 3 mm were mixed with each other in approximately the same amount) having the same bulk (volume) as that of the weighed raw material powder, and ethanol enough to immerse all of the raw material powder and the balls were further added to the pot. Thereafter, a resin packing was interposed between the pot and a lid, and the lid was closed. The pot was installed in a planetary ball mill device, and the pot and the lid were firmly pressed by a press tool attached to the device to prevent the powder and the ethanol from overflowing through a gap between the pot and the lid during the operation. Then, rotation and revolution for each of 500 times of rotations were performed for 12 hours to mix them well.

After the mixing by the planetary ball mill was completed, contents in the pot were taken out, and the zirconia balls were removed therefrom, thereby obtaining a mixed raw material powder dispersed in ethanol. The powder was heated while being stirred by a hot stirrer to evaporate the ethanol. Since the mixed raw material powder obtained after the ethanol evaporation was solid, the powder was crushed by a mortar to be pulverized again.

The mixed raw material powder was gently poured into an alumina crucible so as not to be densely filled, the crucible is installed in a vacuum furnace, and then the crucible was sealed. A process of evacuating the inside of the furnace and replacing the inside of the furnace with nitrogen to remove oxygen from the furnace was repeated 3 times. At this time, in the evacuation and nitrogen introduction, an exhaust speed and an introduction speed were slowed down as much as possible so that the powder in the crucible was prevented from scattering. After the third nitrogen replacement was performed, evacuation was further performed, and the inside of the furnace was heated to 850° C. after waiting for a degree of vacuum to reach about 1 Pascal or less. The heat treatment was performed at 850° C. for 3 hours, the furnace was opened to the atmosphere after waiting for the temperature inside the furnace to reach 50° C. or lower, and the crucible was taken out from the furnace.

When the powder in the crucible was taken out, since some of the particles were bonded to each other and coarse particles were thus formed, the powder was placed in an agate mortar, and the powder was crushed by an agate pestle. As a result of measuring a particle size of the powder after being crushed by the mortar with an optical particle size distribution meter, the particle size of the powder was about several tens of μm.

The powder was placed in the zirconia pot for a planetary ball mill. Further, zirconia balls (balls having a diameter of 0.5 mm and balls having a diameter of 1 mm were mixed with each other in approximately the same amount) having the same bulk (volume) as that of the powder, and ethanol enough to immerse all of the raw material powder and the balls were further added to the pot. Thereafter, a resin packing was interposed between the pot and a lid, and the lid was closed. The pot was installed in the planetary ball mill device, and the pot and the lid were firmly pressed by the press tool attached to the device to prevent the powder and the ethanol from overflowing through the gap between the pot and the lid during the operation. Then, the rotation and revolution for each of 500 times of rotations were performed for 24 hours.

After the mixing by the planetary ball mill was completed, contents in the pot were taken out, and the zirconia balls were removed therefrom, thereby obtaining a powder ethanol dispersion liquid. A part of the dispersion liquid was taken out, the ethanol was further volatilized, and a number average particle size was measured by an optical microscope. As a result, the number average particle size was about 300 nm.

It was confirmed that the powder having a desired particle size was obtained. Therefore, the powder ethanol dispersion liquid was heated while being stirred by a hot stirrer to evaporate the ethanol. Since the mixed raw material powder obtained after the ethanol evaporation was solid, the powder was crushed by a mortar to be pulverized again.

Through the above process, tungsten oxide particles 1 having a Cs content x of 0.100 and a number average particle size of 300 nm were obtained.

(Tungsten Oxide Particles 2 to 5 and C1)

In the production of the tungsten oxide particles 1, a proportion of the raw material was appropriately changed so that the Cs content x was as shown in Table 1. In addition, the time for mixing with the planetary ball mill after the heat treatment was changed as shown in Table 1 by using the zirconia balls having the diameter shown in Table 1 for mixing with the planetary ball mill after the heat treatment. Powders of tungsten oxide particles 2 to 5 and C1 each having a number average particle size as shown in Table 1 were obtained in the same manner as in the case of the tungsten oxide particles 1 except for the above conditions.

(Tungsten Oxide Particles 6 and 7)

The time for mixing with the planetary ball mill after the heat treatment was changed as shown in Table 1 by using the zirconia balls having the diameter shown in Table 1 for mixing with the planetary ball mill after the heat treatment. Powders of tungsten oxide particles 6 and 7 each having a number average particle size as shown in Table 1 were obtained in the same manner as in the case of the tungsten oxide particles 1 except for the above conditions.

TABLE 1

| | Cs content x | Number average particle size (nm) | Zirconia ball diameter (μm) | Mixing time (hr) |
|---|---|---|---|---|
| Metal oxide particles 1 | 0.100 | 300 | 0.5 mm/1.0 mm | 24 |
| Metal oxide particles 2 | 0.050 | 300 | 0.5 mm/1.0 mm | 24 |
| Metal oxide particles 3 | 0.010 | 300 | 0.5 mm/1.0 mm | 24 |
| Metal oxide particles 4 | 0.005 | 300 | 0.5 mm/1.0 mm | 24 |
| Metal oxide particles 5 | 0.001 | 300 | 0.5 mm/1.0 mm | 24 |
| Metal oxide particles 6 | 0.005 | 50 | 0.1 mm/1.0 mm | 72 |
| Metal oxide particles 7 | 0.005 | 800 | 1.0 mm | 12 |
| Metal oxide particles C1 | 0.000 | 300 | 0.5 mm/1.0 mm | 24 |

<Production of Electrophotographic Photosensitive Member>

[Preparation Example of Coating Liquid for Intermediate Layer]

(Preparation Example of Coating Liquid 1 for Intermediate Layer)

50 parts of a phenol resin (a monomer/oligomer of the phenol resin) (trade name: PHENOLITE J-325, manufactured by DIC Corporation, resin solid content: 60%, density after curing: 1.3 g/cm$^2$) were prepared. The phenol resin was dissolved in 35 parts of 1-methoxy-2-propanol as a solvent to obtain a solution.

110 parts of the tungsten oxide particles 1 were added to the solution, and the mixture was charged into a vertical sand mill using 120 parts of glass beads having an average particle size of 1.0 mm as a dispersion medium. Thereafter, a dispersion treatment was performed under conditions of a dispersion liquid temperature of 23±3° C. and a rotational speed of 1,500 rpm (peripheral velocity of 5.5 m/s) for 4 hours, thereby obtaining a dispersion liquid. The glass beads were removed from the dispersion liquid with a mesh.

0.01 parts of silicone oil (trade name: SH28 PAINT ADDITIVE, manufacture by Dow Corning Toray Co., Ltd.) as a leveling agent were prepared. In addition, 10 parts of silicone resin particles (trade name: Tospearl 120, manufactured by Momentive Performance Materials Inc., average particle size: 2 μm, density: 1.3 g/cm$^2$) as a surface roughness imparting material were prepared. These materials were added to the dispersion liquid from which the glass beads were removed, stirring was performed, and the mixture was subjected to pressure-filtration using a PTFE filter paper (trade name: PF060, manufactured by Advantec Toyo Kaisha, Ltd.), thereby preparing a coating liquid 1 for an intermediate layer.

(Preparation Examples of Coating Liquids 2 to 9 for Intermediate Layer)

Coating liquids 2 to 9 for an intermediate layer were prepared in the same operation as that in the preparation example of the coating liquid 1 for an intermediate layer, except that each of the type and use amount of the tungsten oxide particle used in the preparation of the coating liquid for an intermediate layer was as shown in Table 2.

(Preparation Example of Coating Liquid 10 for Intermediate Layer)

15 parts of a butyral resin (trade name: BM-1, manufactured by Sekisui Chemical Co., Ltd.) and 18.75 parts of a blocked isocyanate resin (trade name: TPA-B80E, 80% solution, manufactured by Asahi Kasei Corporation) were prepared. These materials were dissolved in a mixed solvent of 45 parts of methyl ethyl ketone and 85 parts of 1-butanol to obtain a solution.

110 parts of the tungsten oxide particles 4 were added to the solution, and the mixture was charged into a vertical sand mill using 120 parts of glass beads having an average particle size of 1.0 mm as a dispersion medium. Thereafter, a dispersion treatment was performed under conditions of a dispersion liquid temperature of 23±3° C. and a rotational speed of 1,500 rpm (peripheral velocity of 5.5 m/s) for 4 hours, thereby obtaining a dispersion liquid. The glass beads were removed from the dispersion liquid with a mesh.

0.01 parts of silicone oil (trade name: SH28 PAINT ADDITIVE, manufacture by Dow Corning Toray Co., Ltd.) as a leveling agent were prepared. In addition, 5 parts of crosslinked polymethyl methacrylate (PMMA) particles (trade name: Techpolymer SSX-102, manufactured by Sekisui Kasei Co., Ltd., average primary particle size: 2.5 μm) as a surface roughness imparting material were prepared. These materials were added to the dispersion liquid from which the glass beads were removed, stirring was performed, and the mixture was subjected to pressure-filtration using a PTFE filter paper (trade name: PF060, manufactured by Advantec Toyo Kaisha, Ltd.), thereby preparing a coating liquid 10 for an intermediate layer.

(Preparation Example of Coating Liquid C1 for Intermediate Layer)

A coating liquid C1 for an intermediate layer was prepared in the same operation as that in the preparation example of the coating liquid 1 for an intermediate layer, except that the type and use amount of the tungsten oxide particle used in the preparation of the coating liquid for an intermediate layer were as shown in Table 2.

TABLE 2

| | Tungsten oxide particles | |
|---|---|---|
| | Type | Use amount (parts) |
| Coating liquid for intermediate layer 1 | Tungsten oxide particles 1 | 110 |
| Coating liquid for intermediate layer 2 | Tungsten oxide particles 2 | 110 |
| Coating liquid for intermediate layer 3 | Tungsten oxide particles 3 | 110 |
| Coating liquid for intermediate layer 4 | Tungsten oxide particles 4 | 110 |
| Coating liquid for intermediate layer 5 | Tungsten oxide particles 5 | 110 |
| Coating liquid for intermediate layer 6 | Tungsten oxide particles 6 | 110 |

TABLE 2-continued

| | Tungsten oxide particles | |
|---|---|---|
| | Type | Use amount (parts) |
| Coating liquid for intermediate layer 7 | Tungsten oxide particles 7 | 110 |
| Coating liquid for intermediate layer 8 | Tungsten oxide particles 4 | 130 |
| Coating liquid for intermediate layer 9 | Tungsten oxide particles 4 | 80 |
| Coating liquid for intermediate layer 10 | Tungsten oxide particles 4 | 110 |
| Coating liquid for intermediate layer C1 | Tungsten oxide particles C1 | 110 |

(Production Example of Electrophotographic Photosensitive Member 1 (Example 1)

[Support]

An aluminum cylinder (JIS-A3003, aluminum alloy) having a length of 257 mm and a diameter of 24 mm produced by a production method including an extrusion step and a drawing step was used as a support.

[Intermediate Layer]

Under a normal temperature and normal humidity (23° C./50% RH) environment, the coating liquid 1 for an intermediate layer was applied onto the support by dip coating to obtain a coating film, and the obtained coating film was dried and thermally cured at 150° C. for 30 minutes, thereby forming an intermediate layer having a thickness of 30 μm.

[Undercoat Layer]

Next, the following materials were prepared.

4.5 parts of N-methoxymethylated nylon (trade name: Toresin EF-30T, manufactured by Nagase ChemteX Corporation)

1.5 parts of copolymer nylon resin (trade name: Amilan CM8000, manufactured by Toray Industries Inc.)

These materials were dissolved in a mixed solvent of 65 parts of methanol and 30 parts of n-butanol to prepare a coating liquid for an undercoat layer. The coating liquid for an undercoat layer was applied onto the intermediate layer by dip coating to form a coating film, and the obtained coating film was dried at 70° C. for 6 minutes, thereby forming an undercoat layer having a thickness of 0.85 μm.

[Charge Generation Layer]

Next, the following materials were prepared.

10 parts of crystalline hydroxygallium phthalocyanine crystals (charge generating substances) having strong peaks at Bragg angles (2θ±0.2°) of 7.5°, 9.9°, 16.3°, 18.6°, 25.1°, and 28.3° in CuKα characteristic X-ray diffraction 5 parts of polyvinyl butyral (trade name: S-LEC BX-1, manufactured by Sekisui Chemical Co., Ltd.)

250 parts of cyclohexanone

These materials were charged into a sand mill using glass beads having a diameter of 0.8 mm, a dispersion treatment was performed under a condition of a dispersion treatment time of 3 hours, and 250 parts of ethyl acetate were further added, thereby preparing a coating liquid for a charge generation layer. The coating liquid for a charge generation layer was applied onto the undercoat layer by dip coating to form a coating film, and the obtained coating film was dried at 100° C. for 10 minutes, thereby forming a charge generation layer having a thickness of 0.15 μm.

[Charge Transport Layer]

Next, the following materials were prepared.

6.0 parts of amine compound represented by the following Formula (CT-1) (charge transporting substance)

2.0 parts of amine compound represented by the following Formula (CT-2) (charge transporting substance)

10 parts of bisphenol Z-type polycarbonate (trade name: Z400, manufactured by Mitsubishi Engineering-Plastics Corporation)

0.36 parts of siloxane modified polycarbonate having repeating structural unit represented by the following Formula (B-1) and repeating structural unit represented by the following Formula (B-2) and having terminal structure represented by the following Formula (B-3) ((B-1):(B-2)=95:5 (molar ratio)).

These materials were dissolved in a mixed solvent of 60 parts of o-xylene, 40 parts of dimethoxymethane, and 2.7 parts of methyl benzoate to prepare a coating liquid for a charge transport layer. The coating liquid for a charge transport layer was applied onto the charge generation layer by dip coating to form a coating film, and the obtained coating film was dried at 125° C. for 30 minutes, thereby forming a charge transport layer having a thickness of 12.0 μm.

(CT-1)

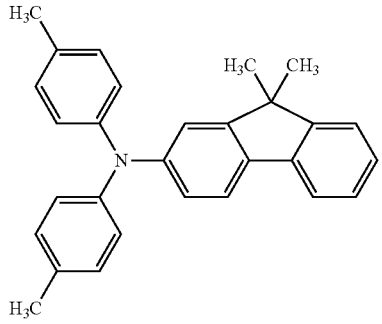

(CT-2)

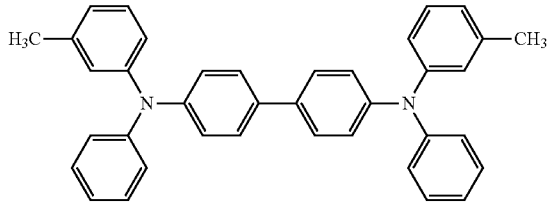

(B-1)

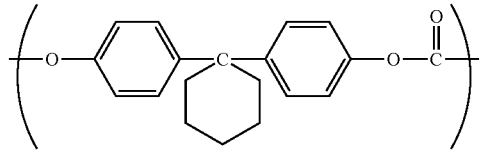

(B-2)

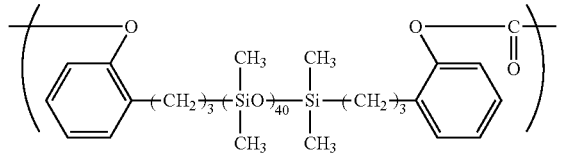

-continued (B-3)

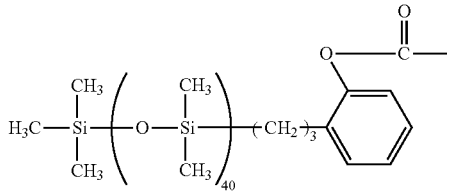

As described above, an electrophotographic photosensitive member 1 having a charge transport layer as a surface layer was produced.

Production Examples of Electrophotographic Photosensitive Members 2 to 9 (Examples 2 to 9)

Electrophotographic photosensitive members 2 to 9 were produced in the same operation as in the production example of the electrophotographic photosensitive member 1, except that the coating liquid for an intermediate layer used in the production of the electrophotographic photosensitive member was changed as shown in Table 3 from the coating liquid 1 for an intermediate layer.

Production Examples of Electrophotographic Photosensitive Members 10 and 11 (Examples 10 and 11)

The coating liquid for an intermediate layer used in the production of the electrophotographic photosensitive member was changed as shown in Table 3 from the coating liquid 1 for an intermediate layer. Electrophotographic photosensitive members 10 and 11 were produced in the same operation as in the production example of the electrophotographic photosensitive member 1, except that the thickness of the intermediate layer was further changed to a value shown in Table 3. The results are shown in Table 3.

Production Example of Electrophotographic Photosensitive Member 12 (Example 12)

An electrophotographic photosensitive member 12 was produced in the same operation as in the production example of the electrophotographic photosensitive member 4, except that the undercoat layer in the production of the electrophotographic photosensitive member was not provided.

(Production Example of Electrophotographic Photosensitive Member 13 (Example 13)

The coating liquid for an intermediate layer used in the production of the electrophotographic photosensitive member was changed to the coating liquid 10 for an intermediate layer from the coating liquid 1 for an intermediate layer. In addition, an electrophotographic photosensitive member 13 having a charge transport layer as a surface layer was produced in the same operation as in the production example of the electrophotographic photosensitive member 1, except that the temperature in drying and thermal curing of the coating film was changed to 170° C.

Production Example of Electrophotographic Photosensitive Member C1 (Comparative Example 1)

An electrophotographic photosensitive member C1 was produced in the same operation as in the production example of the electrophotographic photosensitive member 1, except that the coating liquid for an intermediate layer used in the production of the electrophotographic photosensitive member was changed to the coating liquid C1 for an intermediate layer from the coating liquid 1 for an intermediate layer. The results are shown in Table 3.

(Analysis of Intermediate Layer of Electrophotographic Photosensitive Member)

Five 5 mm square pieces were cut out from each of the produced electrophotographic photosensitive members. Thereafter, the charge transport layer and the charge generation layer of each of the pieces were wiped with chlorobenzene, methyl ethyl ketone, and methanol to expose the intermediate layer. As described above, five sample pieces for observation were prepared for each electrophotographic photosensitive member.

First, one sample piece for each electrophotographic photosensitive member was used for thinning of the intermediate layer to a thickness of 150 nm. The thinning of the intermediate layer was performed by an FIB-μ sampling method using a focused ion beam machining observation device (trade name: FB-2000A, manufactured by Hitachi High-Tech Manufacturing & Service Corporation).

Subsequently, the composition of the intermediate layer was analyzed using the obtained thin piece. A field emission type electron microscope (HRTEM) (trade name: JEM-2100F, manufactured by JEOL, Ltd.) and an energy dispersive X-ray analyzer (EDX) (trade name: JED-2300T, manufactured by JEOL, Ltd.) were used for the composition analysis. The measurement conditions for EDX were an acceleration voltage of 200 kV and a beam diameter of 1.0 nm.

Next, in each of the electrophotographic photosensitive members, the intermediate layer was formed into a three-dimensional image of 2 μm×2 μm×2 μm by a Slice & View of FIB-SEM using the remaining four sample pieces. From a difference in contrast in the Slice & View of FIB-SEM, a content ratio (vol %) of the tungsten oxide particles with respect to a total volume of the intermediate layer was calculated. Conditions of the Slice & View were as follows.

Processing of sample for analysis: FIB method
Processing and observation device: NVision40, manufactured by SII/Zeiss
Slice interval: 10 nm
Observation conditions:
Acceleration voltage: 1.0 kV
Inclination of sample: 54°
WD: 5 mm
Detector: BSE detector
Aperture: 60 μm, high current
ABC: ON
Image resolution: 1.25 nm/pixel The analysis area was 2 μm in length×2 μm in width. The information for every cross section was integrated to determine a volume V of the tungsten oxide particles per area of 2 μm in length×2 μm in width×2 μm in thickness (8 $\mu m^3$). In addition, the measurement environment was a temperature of 23° C. and a pressure of $1\times10^{-4}$ Pa. Strata 400S (inclination of sample: 52°) manufactured by FEI Company was used as the processing and observation device. In addition, the information for each cross section was obtained by analyzing an image of the area of the identified tungsten oxide particles. The image analysis was performed using an Image-Pro Plus (image processing software, manufactured by Media Cybernetics Inc.).

In each of the four sample pieces, a volume V of the tungsten oxide particles in the volume of 2 μm×2 μm×2 μm (unit volume: 8 $\mu m^3$) was determined based on the obtained information. Then, a content ratio of the tungsten oxide particles in each sample piece was calculated based on a formula of V $\mu m^3$/8 $\mu m^3$×100. An average value of the content ratios of the tungsten oxide particles in four sample pieces was a content ratio (vol %) of the tungsten oxide particles with respect to the total volume of the intermediate layer.

The content ratio (vol %) of the tungsten oxide particles with respect to the total volume of the intermediate layer obtained by the analysis in the electrophotographic photosensitive member in each of Examples and Comparative Examples is shown in Table 3 together with the thickness and volume resistivity of the intermediate layer.

TABLE 3

| Example No. | Electrophotographic photosensitive member No. | Coating liquid for intermediate layer No. | Thickness of intermediate layer (μm) | Content ratio of tungsten oxide particles to total volume of intermediate layer (vol %) | Volume resistivity of intermediate layer (Ω · cm) |
|---|---|---|---|---|---|
| Example 1 | Electrophotographic photosensitive member 1 | Coating liquid for intermediate layer 1 | 30 | 38 | $8.0 \times 10^{12}$ |
| Example 2 | Electrophotographic photosensitive member 2 | Coating liquid for intermediate layer 2 | 30 | 38 | $3.7 \times 10^{12}$ |
| Example 3 | Electrophotographic photosensitive member 3 | Coating liquid for intermediate layer 3 | 30 | 38 | $1.8 \times 10^{12}$ |
| Example 4 | Electrophotographic photosensitive member 4 | Coating liquid for intermediate layer 4 | 30 | 38 | $1.2 \times 10^{11}$ |
| Example 5 | Electrophotographic photosensitive member 5 | Coating liquid for intermediate layer 5 | 30 | 38 | $2.7 \times 10^{11}$ |
| Example 6 | Electrophotographic photosensitive member 6 | Coating liquid for intermediate layer 6 | 30 | 38 | $1.3 \times 10^{11}$ |
| Example 7 | Electrophotographic photosensitive member 7 | Coating liquid for intermediate layer 7 | 30 | 38 | $1.1 \times 10^{10}$ |
| Example 8 | Electrophotographic photosensitive member 8 | Coating liquid for intermediate layer 8 | 30 | 45 | $2.3 \times 10^{11}$ |
| Example 9 | Electrophotographic photosensitive member 9 | Coating liquid for intermediate layer 9 | 30 | 30 | $8.3 \times 10^{11}$ |
| Example 10 | Electrophotographic photosensitive member 10 | Coating liquid for intermediate layer 4 | 15 | 38 | $1.2 \times 10^{11}$ |
| Example 11 | Electrophotographic photosensitive member 11 | Coating liquid for intermediate layer 4 | 40 | 38 | $1.2 \times 10^{11}$ |
| Example 12 | Electrophotographic photosensitive member 12 | Coating liquid for intermediate layer 4 | 30 | 38 | $1.2 \times 10^{11}$ |
| Example 13 | Electrophotographic photosensitive member 13 | Coating liquid for intermediate layer 10 | 30 | 38 | $1.1 \times 10^{11}$ |
| Comparative Example 1 | Electrophotographic photosensitive member C1 | Coating liquid for intermediate layer C1 | 30 | 38 | $3.5 \times 10^{12}$ |

[Evaluation]

Evaluation of Variation in Light-Area Potential During Repetitive Use

Each of the produced electrophotographic photosensitive members was mounted in a laser beam printer (trade name: Color LaserJet Enterprise M552, manufactured by Hewlett-Packard Company) to carry out a paper feeding durability test under an environment of temperature 23° C./relative humidity 50%.

In the paper feeding durability test, a print operation was performed in an intermittent mode in which a text image having a printing rate of 2% was printed on a letter size sheet one by one, and image printing was performed on 25,000 sheets. Then, potentials (light-area potentials) at the time of exposure were measured at the start of the paper feeding durability test and at the end of the image printing on 25,000 sheets. A solid black image was used for the potential measurement. An initial light-area potential (at the start of the paper feeding durability test) was V1, and a light-area potential after the end of the image printing on 25,000 sheets was V1'. Then, the amount of variation in light-area potential ΔV1 (=|V1'|−|V1|) was determined, in which ΔV1 was a difference between the light-area potential V1' after the end of the image printing on 25,000 sheets and the initial light-area potential V1.

The results are shown in Table 4.

TABLE 4

| Example No. | Initial light-area potential Vl (V) | Variation in light-area potential during repetitive use ΔVl (V) |
|---|---|---|
| Example 1 | 130 | 53 |
| Example 2 | 120 | 61 |

TABLE 4-continued

| Example No. | Initial light-area potential Vl (V) | Variation in light-area potential during repetitive use ΔVl (V) |
|---|---|---|
| Example 3 | 110 | 65 |
| Example 4 | 110 | 71 |
| Example 5 | 110 | 75 |
| Example 6 | 113 | 78 |
| Example 7 | 110 | 73 |
| Example 8 | 100 | 63 |
| Example 9 | 115 | 77 |
| Example 10 | 100 | 65 |
| Example 11 | 115 | 77 |
| Example 12 | 110 | 51 |
| Example 13 | 110 | 65 |
| Comparative Example 1 | 130 | 110 |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-087655, filed May 19, 2020 which is hereby incorporated by reference herein in its entirety.

What is claimed is:

1. An electrophotographic photosensitive member comprising:

a support;

an intermediate layer; and a photosensitive layer in this order, wherein the intermediate layer comprises a tungsten oxide particle, wherein the tungsten oxide particle contains a tungsten atom, an oxygen atom, and a cesium atom, and wherein a composition ratio of the cesium atom to the tungsten atom contained in the tungsten oxide particle is 0.1 to 5.0%.

2. The electrophotographic photosensitive member according to claim 1, wherein a number average particle size of the tungsten oxide particles is 50 to 800 nm.

3. A process cartridge integrally supporting an electrophotographic photosensitive member and at least one unit selected from the group consisting of a charging unit, a developing unit, and a cleaning unit, and being detachably attachable to a main body of an electrophotographic apparatus, the electrophotographic photosensitive member comprising:

a support; an intermediate layer; and a photosensitive layer in this order, wherein the intermediate layer comprises a tungsten oxide particle, wherein the tungsten oxide particle contains a tungsten atom, an oxygen atom, and a cesium atom, and wherein a composition ratio of the cesium atom to the tungsten atom contained in the tungsten oxide particle is 0.1 to 5.0%.

4. An electrophotographic apparatus comprising:

an electrophotographic photosensitive member;

a charging unit;

an exposing unit;

a developing unit; and a transfer unit, the electrophotographic photosensitive member comprising a support, an intermediate layer, and a photosensitive layer in this order, wherein the intermediate layer comprises a tungsten oxide particle, wherein the tungsten oxide particle contains a tungsten atom, an oxygen atom, and a cesium atom, and wherein a composition ratio of the cesium atom to the tungsten atom contained in the tungsten oxide particle is 0.1 to 5.0%.

* * * * *